US008948673B2

(12) United States Patent
Suto et al.

(10) Patent No.: US 8,948,673 B2
(45) Date of Patent: Feb. 3, 2015

(54) FIXING-UNIT ROLLER, FIXING UNIT, AND IMAGE FORMING APPARATUS INCLUDING AN ELASTIC LAYER

(71) Applicants: Katsunori Suto, Kanagawa (JP); Norihiko Aze, Kanagawa (JP); Takeshi Endoh, Kanagawa (JP); Masayuki Kami, Kanagawa (JP); Toru Kobayashi, Kanagawa (JP); Kohta Shiodera, Kanagawa (JP)

(72) Inventors: Katsunori Suto, Kanagawa (JP); Norihiko Aze, Kanagawa (JP); Takeshi Endoh, Kanagawa (JP); Masayuki Kami, Kanagawa (JP); Toru Kobayashi, Kanagawa (JP); Kohta Shiodera, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 97 days.

(21) Appl. No.: 13/757,136

(22) Filed: Feb. 1, 2013

(65) Prior Publication Data

US 2013/0209148 A1 Aug. 15, 2013

(30) Foreign Application Priority Data

Feb. 9, 2012 (JP) ..... 2012-026257

(51) Int. Cl.
*G03G 15/20* (2006.01)

(52) U.S. Cl.
CPC ..... *G03G 15/206* (2013.01); *G03G 15/2053* (2013.01); *G03G 2215/2035* (2013.01)
USPC ..... 399/333

(58) Field of Classification Search
USPC ..... 399/333, 330, 331
See application file for complete search history.

(56) References Cited

U.S. PATENT DOCUMENTS

| | | | | |
|---|---|---|---|---|
| 2003/0127173 | A1 | 7/2003 | Kamiya et al. | |
| 2003/0235417 | A1 | 12/2003 | Aze et al. | |
| 2004/0129062 | A1 | 7/2004 | Aze et al. | |
| 2004/0224165 | A1 | 11/2004 | Kondoh et al. | |
| 2005/0123673 | A1 | 6/2005 | Kamiya et al. | |
| 2005/0286938 | A1 | 12/2005 | Aze et al. | |
| 2006/0056890 | A1 | 3/2006 | Aze et al. | |
| 2006/0120778 | A1 | 6/2006 | Aze et al. | |
| 2006/0205578 | A1 * | 9/2006 | Ogawa et al. | |
| 2006/0289420 | A1 | 12/2006 | Hasegawa et al. | |
| 2007/0110994 | A1 * | 5/2007 | Pickering | 399/333 |
| 2007/0140758 | A1 | 6/2007 | Aze et al. | |
| 2008/0003030 | A1 | 1/2008 | Aze et al. | |

(Continued)

FOREIGN PATENT DOCUMENTS

| | | |
|---|---|---|
| JP | 2004-070159 | 3/2004 |
| JP | 2005-024610 | 1/2005 |

(Continued)

OTHER PUBLICATIONS

U.S. Appl. No. 07/774,513, filed Oct. 8, 1991, Wataru Ohtani, et al.

(Continued)

*Primary Examiner* — Susan Lee
(74) *Attorney, Agent, or Firm* — Harness, Dickey & Pierce, P.L.C.

(57) ABSTRACT

A fixing-unit roller includes: a core bar; and an elastic layer formed on an outer peripheral surface of the core bar. The elastic layer is formed from a porous material that contains a plurality of cells. Cells in a cross section obtained by cutting across the porous material are 0.1 μm or greater and 50 μm or less in size. A ratio of an area occupied by composite cells, which are made of partially-overlapping spherical cells, in a 200-μm square in the cross section to an area of the square is 60% or greater and 70% or less.

7 Claims, 6 Drawing Sheets

(56) References Cited

U.S. PATENT DOCUMENTS

| | | | | |
|---|---|---|---|---|
| 2008/0063444 | A1 | 3/2008 | Kondoh et al. | |
| 2008/0070031 | A1* | 3/2008 | Rasch et al. | 399/333 |
| 2009/0133804 | A1 | 5/2009 | Kanematsu et al. | |
| 2011/0021649 | A1 | 1/2011 | Sakuma et al. | |
| 2011/0074061 | A1 | 3/2011 | Nozoe et al. | |

FOREIGN PATENT DOCUMENTS

| | | |
|---|---|---|
| JP | 3667651 | 4/2005 |
| JP | 2008-214625 | 9/2008 |
| JP | 4761298 | 6/2011 |
| JP | 4766508 | 6/2011 |
| JP | 4795715 | 8/2011 |
| WO | WO2009/142151 A1 | 11/2009 |

OTHER PUBLICATIONS

U.S. Appl. No. 08/023,421, filed Feb. 23, 1993, Wataru Ohtani, et al.

* cited by examiner

FIXING-UNIT ROLLER, FIXING UNIT, AND IMAGE FORMING APPARATUS INCLUDING AN ELASTIC LAYER

CROSS-REFERENCE TO RELATED APPLICATIONS

The present application claims priority to and incorporates by reference the entire contents of Japanese Patent Application No. 2012-026257 filed in Japan on Feb. 9, 2012.

BACKGROUND OF THE INVENTION

1. Field of the Invention

The present invention relates to a fixing-unit roller such as a pressing roller used in a fixing unit in an electrophotographic copier, a printer, a facsimile, or the like to fix a not-yet-fixed toner image, and a fixing unit and an image forming apparatus including the fixing-unit roller.

2. Description of the Related Art

As fixing units used in various image forming apparatuses such as copiers, printers, facsimiles, and multifunction peripherals having functions of these machines, there have been known fixing units that include a thin fixing belt made up of a metal substrate and an elastic rubber layer, for example. Employing a thin fixing belt that is reduced in thermal capacity leads to considerable reduction in energy necessary to heat the fixing belt, thereby making it possible to reduce warm-up time (time for heating from a room temperature to a predetermined printable temperature (reload temperature) at power-on or a like situation) and first print time (time from receipt of a print request to when discharge of a sheet on which, after preparation for printing, printing is performed is finished).

FIG. 2 illustrates an example of a fixing unit. A fixing unit 40 includes a fixing belt 3 which is a rotatable fixing rotating body, a pressing roller 4 which is a opposed rotating body arranged to be opposed to the fixing belt 3 and to be rotatable, a halogen heater 23 which is a heating source that heats the fixing belt 3, a nip forming member 24 arranged inside the fixing belt 3, a stay 25 which is a support member that supports the nip forming member 24, and a reflector 26 that reflects light emitted from the halogen heater 23, toward the fixing belt 3. The fixing belt 3 includes a thin, flexible endless belt member (that may be a film).

FIG. 4 is a schematic cross-sectional view of the pressing roller 4. In this example, an elastic layer 42 of a porous material and a releasing layer 43 of polytetrafluoroethylene are laminated in this order on an outer surface of a cylindrical metal core bar 41.

According to a technique disclosed in Japanese Patent No. 4795715, an elastic layer of such a pressing roller as the pressing roller 4 is formed from a low hardness sponge having obtained by foaming silicone rubber. According to Japanese Patent No. 4795715, using such a low hardness sponge obtained by foaming silicone rubber allows not only reduction in warm-up time but also providing a sufficiently wide nip width while satisfying generally-required compactness, thereby allowing favorable image fixation. However, although this technique can reduce warm-up time, the technique is disadvantageous in that the sponge layer has low endurance because an external force applied to the sponge layer damages the sponge layer in a short period. Furthermore, hardness of the sponge layer decreases sharply, a nip pressure drops in a short period, making it difficult to maintain a predetermined nip pressure. This results in insufficient image fixation.

Accordingly, to prolong usable life of such a low hardness sponge, it is necessary to impose restrictions such as low pressure and low load by employing a pressure-releasing mechanism for the roller or the like. As a result, a usable range of the roller becomes disadvantageously narrow.

An elastic foamed heat insulation layer having open cells and formed from a water-emulsion silicone rubber composition using water as a dispersant has been proposed. The elastic foamed heat insulation layer can be obtained using what is called as a water foaming silicone method. According to this method, minute cells having open-cell structure are produced. Accordingly, an increase in outside diameter of a roller due to thermal expansion and/or a decrease in hardness resulting from breakage of cells during heating can be prevented, and therefore endurance can be increased.

However, still further increase in endurance is desired in practical use.

In view of the above, there is a need to provide a fixing-unit roller capable of providing a wide nip width even when the roller has a small diameter and reducing warm-up time while being highly durable, and a fixing unit including such a roller.

SUMMARY OF THE INVENTION

It is an object of the present invention to at least partially solve the problems in the conventional technology.

A fixing-unit roller includes: a core bar; and an elastic layer formed on an outer peripheral surface of the core bar. The elastic layer is formed from a porous material that contains a plurality of cells. Cells in a cross section obtained by cutting across the porous material are 0.1 μm or greater and 50 μm or less in size. A ratio of an area occupied by composite cells, which are made of partially-overlapping spherical cells, in a 200-μm square in the cross section to an area of the square is 60% or greater and 70% or less.

A fixing unit includes the fixing-unit roller as described above.

An image forming apparatus includes the fixing unit as described above.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 6A and 6B are explanatory diagrams of an image analysis method, in which FIG. 6A is a photograph that is not binarized into black and white yet, and FIG. 6B is a photograph that is binarized into black and white;

DETAILED DESCRIPTION OF THE PREFERRED EMBODIMENTS

An embodiment of the present invention is described below with reference to the accompanying drawings.

Figure 1:
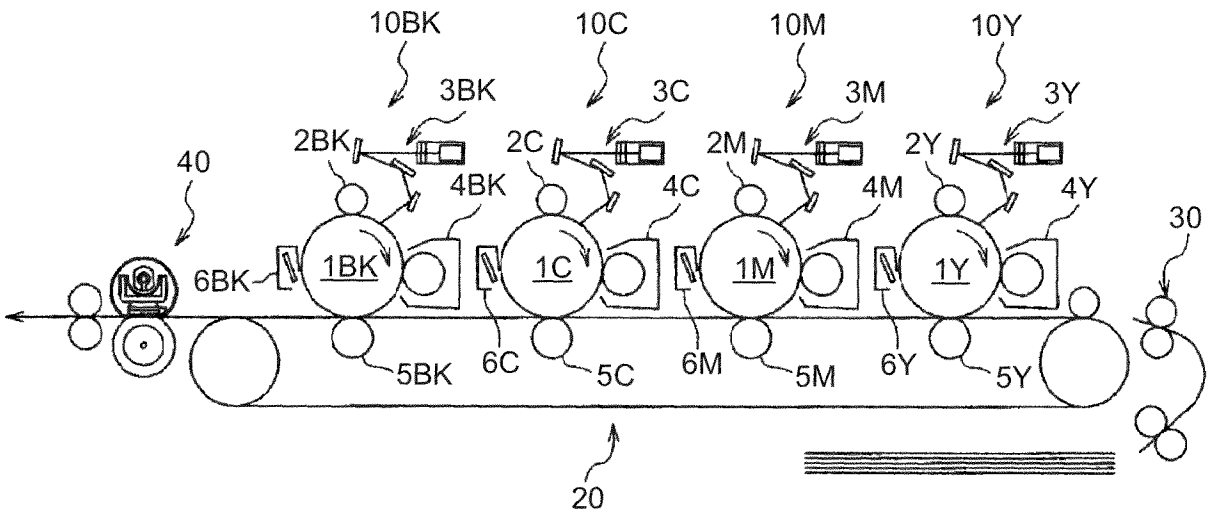
FIG. 1 is a schematic diagram illustrating an example of an image forming apparatus that includes a fixing-unit roller according to an embodiment of the present invention.

FIG. 1 is a schematic diagram illustrating a configuration of an image forming apparatus (printer) that includes a fixing-unit roller according to an embodiment of the present invention.

The printer includes image forming units 10Y, 10M, 10C, and 10Bk to form images of four colors, or yellow, magenta, cyan, and black, on surfaces of photosensitive elements (image carriers) 1Y, 1M, 1C, and 1Bk, respectively.

A conveying belt 20 to convey a sheet of paper (recording medium) through the image forming units 10Y, 10M, 10C, and 10Bk is supported and stretched at a position below the image forming units.

Each of the photosensitive elements 1Y, 1M, 1C, and 1Bk of the image forming units 10Y, 10M, 10C, and 10Bk is in rotatable contact with the conveying belt 20. A sheet (recording medium) is electrostatically attracted to the surface of the conveying belt 20.

The image forming units 10Y, 10M, 10C, and 10Bk are substantially identical in structure. Accordingly, the image forming unit 10Y for yellow located most upstream in a sheet conveying direction is representatively described below, and detailed description of the image forming units 10M, 10C, and 10Bk for the other colors, constituents of which are denoted by like reference numerals, is omitted below.

The photosensitive element 1Y that is in rotatable contact with the conveying belt 20 is arranged at substantially center of the image forming unit 10Y. A charging unit 2Y that electrostatically charges the surface of the photosensitive element 1Y to a predetermined potential, an exposure unit 3Y that exposures the charged drum surface according to a color-separated image signal to form an electrostatic latent image on the drum surface, a developing unit 4Y that develops the electrostatic latent image formed on the drum surface by supplying yellow toner, a transfer roller 5Y (transfer unit) that transfers the developed toner image onto a sheet of paper conveyed via the conveying belt 20, a cleaner 6Y that removes residual toner that is not transferred but left on the drum surface, and a neutralization lamp (not shown) that neutralizes electrical charges remaining on the drum surface are arranged around the photosensitive element 1Y in this order along a rotating direction of the photosensitive element 1Y.

A sheet feeding mechanism 30 to feed a sheet of paper onto the conveying belt 20 is arranged below and on the right of the conveying belt 20 in FIG. 1.

The fixing unit 40 according to the embodiment, which will be described later, is arranged on the left of the conveying belt 20 in FIG. 1 (an exciting coil and the like are omitted from FIG. 1). A sheet conveyed by the conveying belt 20 is further conveyed along a conveying path continued from the conveying belt 20 and extending through the fixing unit 40 and passes through the fixing unit 40.

The fixing unit 40 applies heat and pressure to the conveyed sheet, or, specifically, the sheet with the toner images of the colors transferred on its surface. The toner images of the colors are fused, permeated to and thus fixed to the sheet. The sheet is discharged downstream of the fixing unit 40 in a conveying path via a sheet discharging roller.

The fixing unit according to the embodiment of the present invention is described below with reference to FIG. 2.

Figure 2:
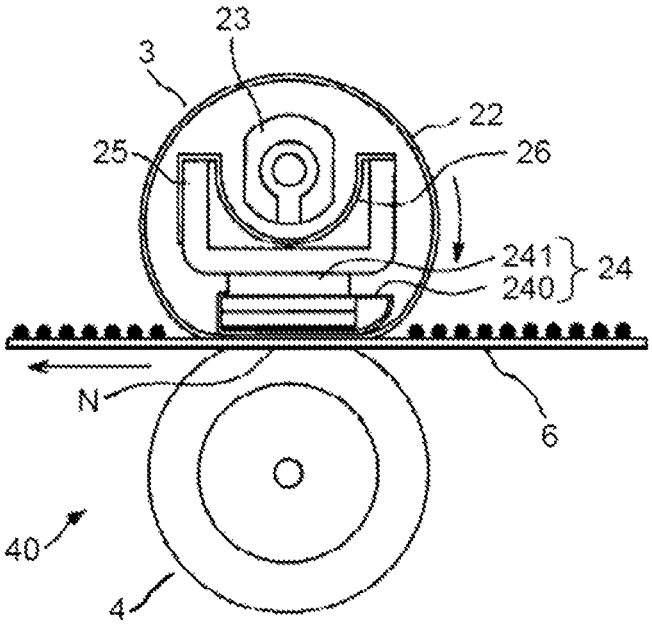
FIG. 2 is a schematic diagram illustrating an example of a fixing unit according to the embodiment.

As illustrated in FIG. 2, the fixing unit 40 includes the fixing belt 3 which is the rotatable fixing rotating body, the pressing roller 4 which is the opposed rotating body arranged to be opposed to the fixing belt 3 and to be rotatable, the halogen heater 23 which is the heating source that heats the fixing belt 3, the nip forming member 24 arranged inside the fixing belt 3, the stay 25 which is the support member that supports the nip forming member 24, and the reflector 26 that reflects light emitted from the halogen heater 23, toward the fixing belt 3.

The fixing belt 3 includes the thin, flexible endless belt member (that may be a film).

Figure 3:
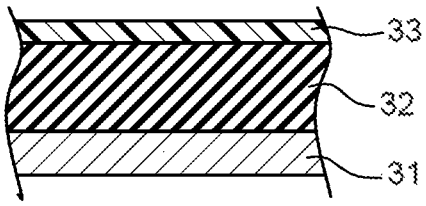
FIG. 3 is a schematic cross-sectional view of a fixing belt.

Specifically, the fixing belt 3 includes a substrate 31 formed from a metal material such as nickel or steel use stainless (SUS) or a plastic material such as polyimide (PI) on the inner circumference side, and a releasing layer 33 formed from tetrafluoroethylene-perfluoroalkylvinyl ether copolymer (PFA), polytetrafluoroethylene (PTFE), or the like on the outer circumference side. An elastic layer 32 formed from a rubber material such as silicone rubber, silicone foam rubber, or fluoro rubber may be interposed between the substrate and the releasing layer as illustrated in FIG. 3.

Figure 4:
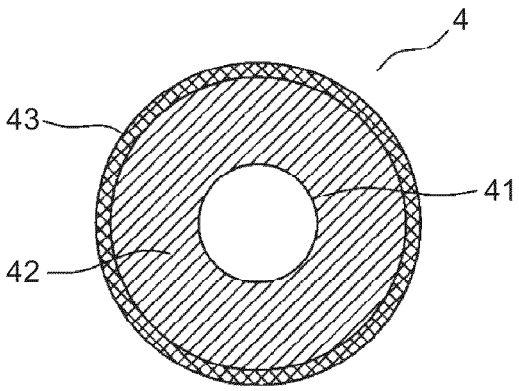
FIG. 4 is a schematic cross-sectional view of the fixing-unit roller according to the embodiment taken perpendicularly to its axis.
Figure 5:
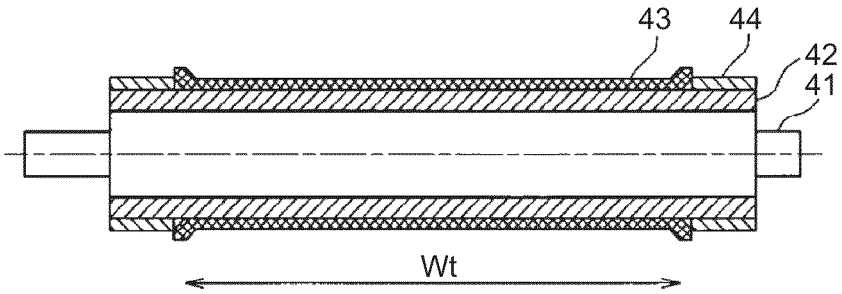
FIG. 5 is a schematic cross-sectional view of the fixing-unit roller according to the embodiment taken along its axis.

FIG. 4 is a schematic cross-sectional view of the pressing roller 4 taken perpendicularly to its axis. FIG. 5 is a schematic cross-sectional view of the pressing roller 4 taken along the axis. The pressing roller 4 is the fixing-unit roller according to the present invention. The pressing roller 4 includes the core bar 41 which is a cylindrical metal member, the elastic layer 42 formed from silicone foam rubber, and the surface releasing layer 43 formed from tetrafluoroethylene-perfluoroalkylvinyl ether copolymer (PFA) or polytetrafluoroethylene (PTFE). The elastic layer 42 and the surface releasing layer 43 are laminated in this order on the core bar 41. A grip layer 44 formed from a rubber material that prevents slip relative to the fixing belt is formed on each of portions near the opposite ends of the elastic layer 42 in place of the releasing layer 43. The outside diameter of the pressing roller 4 is approximately 20 to 40 mm in this example.

The core bar 41 is preferably formed from a highly-rigid metal material such as stainless steel or carbon steel. Concerning thickness of the core bar, in the present invention, the core bar can be either hollow or solid since thermal insulation is provided by employing a porous material of silicone foam rubber employed as the elastic layer.

Thermal insulation can be obtained by employing water-foamed silicone rubber as the elastic layer 42, thereby reducing heat conduction to the pressing roller 4 and making it possible to achieve reduction in warm-up time of the apparatus and energy saving (i.e., reduction of Typical Electricity Consumption (TEC) value).

The porous material forming the elastic layer 42 has thermal conductivity of 0.1 to 0.2 W/(m·K) and hardness of ASKER-C 20 to 60°. Cells in a cross section obtained by cutting the porous material are 0.1 μm or greater and 50 μm or less in size. A ratio of an area occupied by composite cells, which are each made of partially-overlapping spherical cells, in a 200-μm square in the cross section to an area of the square is 60% or greater and 70% or less. Further, the cells in the cross section obtained by cutting the porous material are 0.1

μm or greater and 50 μm or less in size, and, when cells of the porous material that are 5 μm or greater and 50 μm or less in size are sorted in 5-μm increments, cells that are 5 μm or greater and 10 μm or less are largest in number. Meanwhile, the composite cells are easily distinguishable from closed cells by observing the cross section with a microscope or the like because, unlike the spherical shape of the closed cells, the composite cells have a shape formed by partially overlapping spherical shapes.

When a ratio of the number of cells that are 10 μm or greater and 20 μm or less to the number of the cells that are 5 μm or greater and 10 μm or less is 45% or greater, a stress caused by pressure application can be distributed more evenly. As a result, higher endurance can be obtained.

Meanwhile, generally known as methods of manufacturing a porous material are chemical foaming that forms a foam structure by adding a foaming agent and a water foaming silicone method that forms a foam structure by emulsifying water in liquid silicone rubber and heating the emulsion to vaporize the water. Cells in foam formed by chemical foaming are large in size. Accordingly, using the foam in a fixing rotating body of a copier is disadvantageous because formation of an uneven image and/or lack of endurance (decrease in hardness, breakage, or the like) are likely to occur because a pressure cannot be applied to toner evenly. In contrast, because minute and uniform cells can be formed by the water foaming silicone method, a pressure can be applied to toner evenly, and a stress caused by the pressure application can be received evenly, resulting in that lack of endurance is less prone to occur.

The porous material that forms the elastic layer according to the embodiment can be obtained by applying, for instance, a technique proposed as water-foamed silicone.

Specifically, although a water-foamed silicone composition disclosed in the publication is used, this composition is agitated so as to finally yield such a porous material that contains cells that are 0.1 μm or greater and 50 μm or less in size in a cross section obtained by cutting the porous material, and, when cells of the porous material that are 5 μm or greater and 50 μm or less are sorted in 5-μm increments, cells that are 5 μm or greater and 10 μm or less are largest in number.

More specifically, the elastic layer 42 described above is prepared as follows. A catalyst, a surfactant, and a cross-linking agent are added to commercially-available two-pack-type liquid silicone, the mixture is mixed, and a mixed solution obtained by mixing water (to which alcohol is added as required), an additive, a filler, a dispersant, and the like and caused to have viscosity equal to that of liquid silicone rubber is added and agitated to obtain an emulsion composition.

A mixing proportion of the liquid silicone rubber and the mixed solution varies depending on intended porosity. For instance, when the mixing proportion of the liquid silicone rubber and the mixed solution is 1:1, a porous material having porosity of 50% can be obtained because minute globules of water in the emulsion evaporate to become cells.

For the emulsion, a homogenizer or an agitator that uses ultrasonic vibration as required is used and various agitation conditions such as an agitation unit, agitation time, and an agitation speed (for example, 300 to 1,500 rμm) are adjusted so as to achieve the cell distribution that satisfies the conditions described above.

Thereafter, the prepared emulsion composition is poured into a mold and heated to cure the silicone rubber without causing moisture in the emulsion composition to evaporate (primary heating). Hear, a heating temperature is in a range of 80 to 130° C., and heating time is in a range of 30 to 120 minutes. Preferably, the heating temperature is 90 to 110° C., and the heating time is 60 to 90 minutes.

Subsequently, secondary heating is performed to remove moisture from the porous material having undergone the primary heating. A heating temperature is in a range of 150 to 300° C., and heating time is in a range of 1 to 24 hours. Preferably, the heating temperature is 200 to 250° C., and the heating time is 3 to 5 hours. With this secondary heating, moisture is removed from the porous material, cells are made have open-cell structure, and final curing of the silicone rubber is completed.

The porous material obtained in the way described above is fixed to the core bar with an adhesive or the like, and the porous material is scraped to have a predetermined outside diameter, thereby forming the porous material into a roller shape.

An one pack type thermosetting adhesive is evenly applied to a peripheral surface of the shaped elastic layer, which is then covered with a fluoroplastic tube that forms the releasing layer 43. The fixing-unit roller of the present embodiment is thus obtained.

Hear, it is possible that the releasing layer 43 is not formed at each of portions near the opposite ends of the elastic layer but the grip layer is formed instead. The grip layer 44 is formed in areas each between a corresponding end of the releasing layer, which has a same width as a sheet-passing area Wt, and a corresponding end of the elastic layer. It may be formed by coating a grip layer forming composition with spraying, dipping, roll coating or the like and then drying the coated grip layer forming composition. A material of the grip layer is required to have three properties: being tacky to provide gripping force, being an elastic material to form a nip, and having heat resistance to a fixing temperature. As such a material, a rubber material such as silicone rubber or fluoro rubber is desirably used.

A method of counting the number of cells in the present embodiment is described below.

Figure 6A:
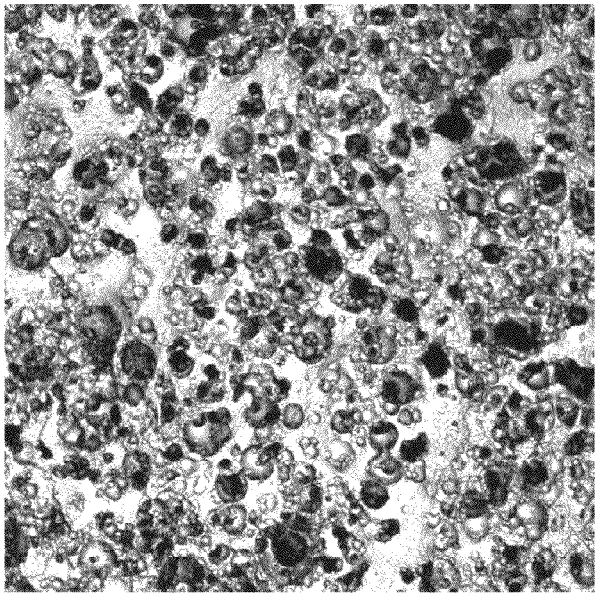

First, the porous material that forms the elastic layer is cut with a sharp cutting tool. The cross section of the porous material is photographed using a laser microscope (LSP) or a scanning electron microscopy (SEM) so as to obtain a sharp image of an area of a 200-μm square (see FIG. 6A).

Figure 6B:
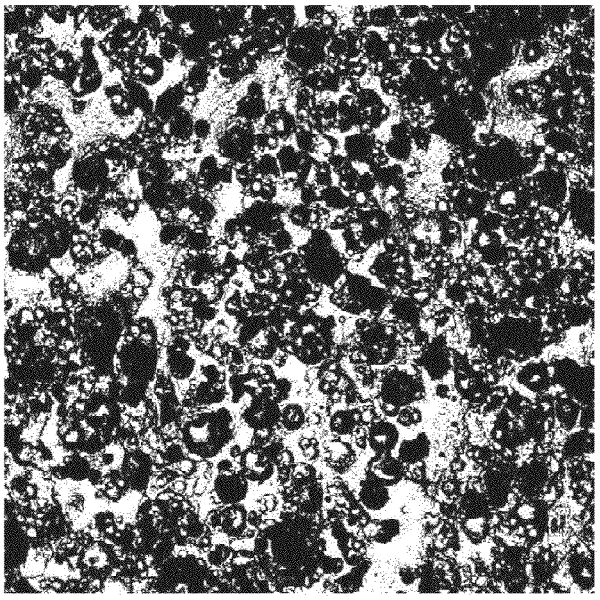

The obtained image is binarized into black and white using commercially-available image processing software in a manner that white portions represent silicone rubber portions, while black portions represent cell portions (see FIG. 6B), and the cell portions are extracted. Thereafter, with treating each of the extracted cells as a component, sorting of the extracted cells according to their diameters is performed using an opening process which is one of image processing methods. By calculating a difference between the images before and after each opening process, the number of pixels of sorted out components (a cell diameter) can be obtained. By dividing this number of pixels by the number of the pixels constituting the component, the number of cells in a corresponding diameter range (i.e., the number of cells contained in a corresponding one of cell groups into which the cells are sorted) can be grasped for each of diameter ranges. As a result, distribution can be obtained.

Meanwhile, the porous material formed by the water-foamed silicone has what is referred to as open-cell structure in which connection is made by minute paths that are formed when water (and alcohol), which is the dispersant, escapes from the formed body.

As described above, in the porous material that forms the elastic layer according to the present embodiment, the ratio of the area occupied by composite cells, which are each made of partially-overlapping spherical cells, in a 200-μm square in the cross section to the area of the square is 60% or greater and 70% or less. Such an area ratio is obtained as follows. A 200-μm square area is extracted from the image data obtained using a microscope. Image portions related to cells other than the composite cells, which are formed by the partial overlap, is visually checked and deleted from this square area. Thereafter, the square area is binarized into black and white, and a ratio of an area of the black portions to an area of the entire square is calculated (using image processing software).

The porosity is calculated using Equation (1) below.

$$\text{porosity (\%)}=((\text{specific gravity of porous material})-(\text{specific gravity of solid rubber}))/(\text{specific gravity of solid rubber})\times 100 \quad (1)$$

The specific gravity is measured using a gravimeter (MD-200S, manufactured by A&D Company Limited).

An open-cell ratio is measured using a ratio of increase in weight after methanol immersion. This method is described in Japanese Patent Application Laid-open No. 2002-12696. Specifically, a cylindrical specimen (approximately 29 mm in diameter and approximately 12.5 mm in thickness) for use in measuring permanent compression set according to JIS K6249 is prepared. The specimen is put in a metal pot of approximately 1-liter capacity filled with 500 g of methanol and immersed therein. The metal pot on which a lid is put is left in an atmosphere of 25° C. The ratio of increase in weight is calculated from the weight of the specimen before the immersion and that after 24-hour immersion using Equation below. When a specimen does not sink but float because of its small specific gravity, a metal mesh is put to cover the upper part of the methanol.

EXAMPLES

The core bar formed from SUM material that was 18 mm in diameter was used. The elastic layer of silicone foam, having open cells, 3.5 mm in thickness and 342 mm in axial length, made from a water-foamed silicone composition manufactured by Toray Dow Corning Silicone Co., Ltd. was formed at a center portion on the outer peripheral surface of the core bar. Hardness of the elastic layer was ASKER-C 40 Hs.

A sheet-passing area at a center portion of this elastic layer was covered with a 30-μm-thick PFA tube as the releasing layer. A 50-μm-thick grip layer of silicone rubber was formed on each of portions near the opposite ends of the elastic layer where the releasing layer was not formed.

Three rollers were made from the water-foamed silicone composition described above in each of several different agitation conditions.

For each of the different agitation conditions, a porous material of the elastic layer of one of the three rollers was cut, and the obtained cross section was photographed with a scanning electron microscope. Among the rollers, a roller in which a ratio of an area occupied by composite cells, which are each made of partially-overlapping spherical cells, in a 200-μm square in the cross section to an area of the square was 60% or greater and 70% or less was selected as Example 1. A roller obtained by agitation at 50 rμm which is a typical agitation speed was used as Comparative Example 1 (conventional example).

Illustrated in Table 1 are evaluation items of the elastic layers of these rollers. The items are: (A) Range of sizes of cells in the cross section; (B) Ratio of the area occupied by composite cells, which are each made of partially-overlapping spherical cells, in the 200-μm square in the cross section to the area of the square; (C) Range of a group into which the largest number of cells are sorted among groups into which cells that are 5 μm or greater and 50 μm or less in the cross section obtained by cutting the porous material are sorted in 5-μm increments; (D) Percentage of the number of cells sorted in a group that is next lager in size of cells than the group of the largest number of cells, to the number of cells in the group of the largest number of cells; (E) Porosity; and (F) Open-cell ratio.

TABLE 1

| Evaluation item | Example 1 | Comparative example |
|---|---|---|
| A | 1 to 40 μm | 1 to 40 μm |
| B | 66% | approx. 0% |
| C | 5 μm to 10 μm | 10 μm to 15 μm |
| D | 59 | 45 |
| E | 43% | 47% |
| F | 70.2% | 9.5% |

The elastic layer of the roller of Example 1 and the elastic layer of the roller of Comparative Example 2 had the same level of thermal conductivity (in a rage of 0.102 to 0.108 W/(m·K)) and hardness (in a range of ASKER-C 26 to 32).

Additionally, analysis of a fixing-unit roller (Comparative Example 2) that was separately prepared by laminating a porous layer (of silicone) and a releasing layer on an outer peripheral surface of a core bar was performed.

Figure 7:
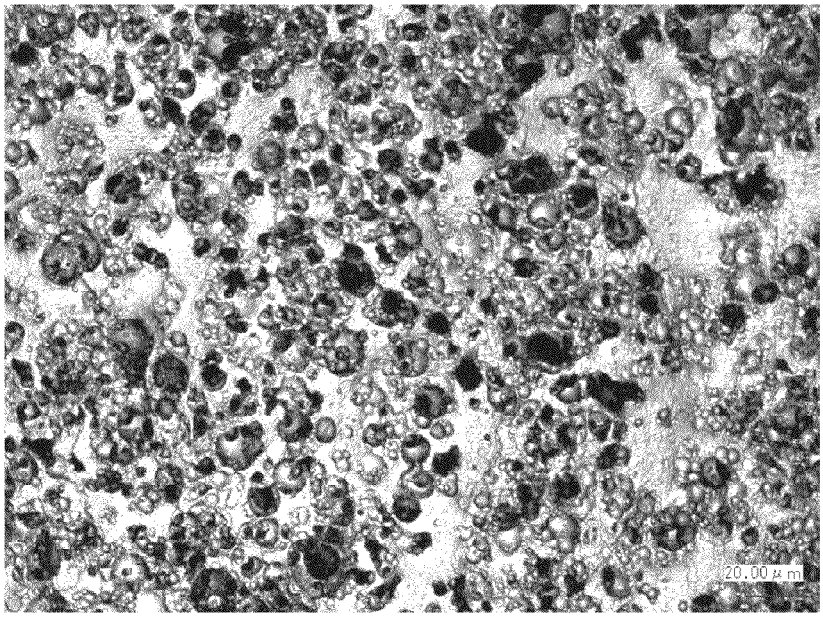
FIG. 7 is a cross-sectional electron micrograph of a porous material that forms an elastic layer of a fixing-unit roller of Example 1.
Figure 8:
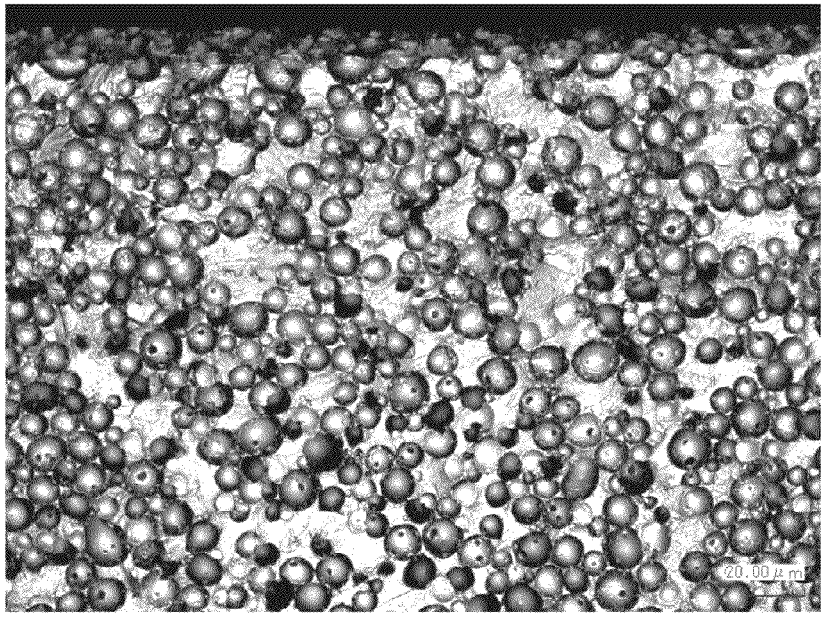
FIG. 8 is a cross-sectional electron micrograph of a porous material that forms an elastic layer of a fixing-unit roller of Comparative Example 1.
Figure 9:
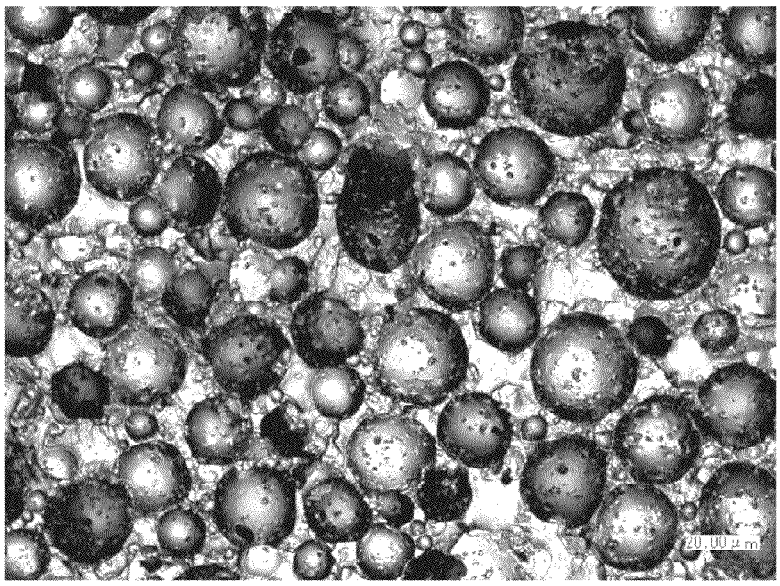
FIG. 9 is a cross-sectional electron micrograph of a porous material that forms an elastic layer of a fixing-unit roller of Comparative Example 2.
Figure 10:
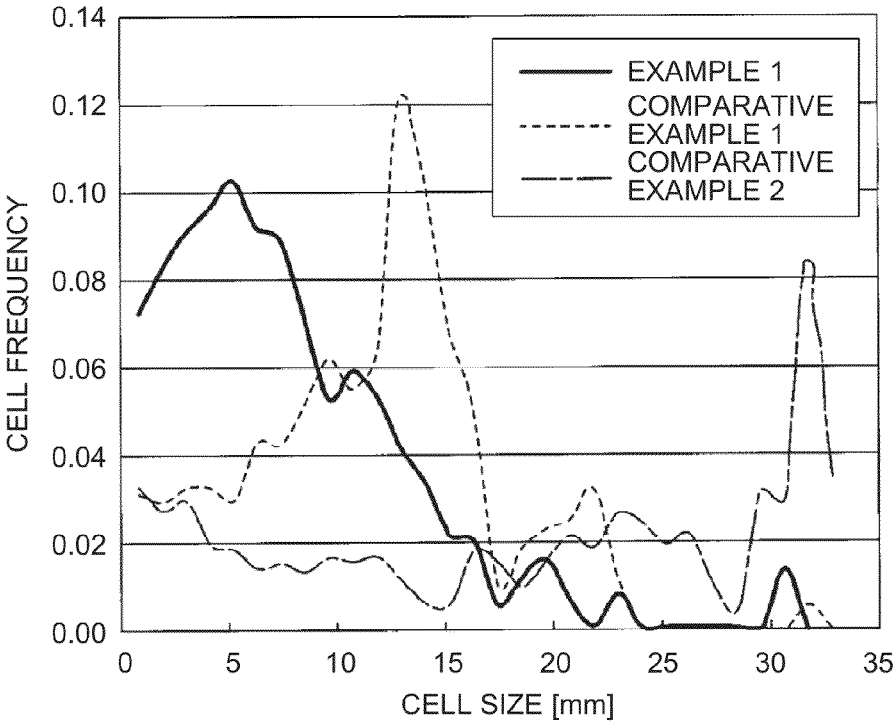
FIG. 10 is a diagram illustrating a result of analysis of sizes of cells contained in the porous materials that form the elastic layers of the fixing-unit rollers of Example 1, Comparative Example 1, and Comparative Example 2.

A cross-sectional micrograph of the elastic layer of the fixing-unit roller of Example 1, that of Comparative Example 1, and that of Comparative Example 2 are presented in FIG. 7, FIG. 8, and FIG. 9, respectively. FIG. 10 illustrates a result of analysis of distribution of sizes of the cells in these cross sections.

These results indicate that the porous material forming the elastic layer of the fixing-unit roller according to the embodiment contains a larger number of smaller cells than those of Comparative Example 1 and Comparative Example 2 and, furthermore, has a wider peak in the distribution than those of Comparative Example 1 and Comparative Example 2.

Evaluation of Fixing-Unit Rollers

Endurance of the fixing-unit rollers of Example 1 and Comparative Example 1 was tested. The endurance test was performed by using each of the above rollers as a pressing roller, causing the pressing roller to be opposed to a heating roller that was 40 mm in diameter and pressing the pressing roller against the heating. The pressing roller was driven to rotate to cause the heating roller to be rotated by rotation of the pressing roller.

A pressing force was applied so as to compress the elastic layer of the pressing roller by 1.2 mm. In this state, the nip width was 7 mm.

The surface temperature of the heating roller was 180° C. The pressing roller was rotated at a rotation speed of 150 rμm intermittently in 5-second-rotation-and-1-second-stop cycles.

As a result, neither foam breakage nor damage was observed in the pressing roller of Example 1 even after testing time exceeded 300 hours. In contrast, foam breakage was observed on a side surface of the pressing roller of Comparative Example 1 when testing time reached 300 hours. Hardness of the roller of Comparative Example 1 was reduced by the endurance test by 8.3%, which was greater than that of the roller of Example 1.

Furthermore, evaluated were four types of fixing-unit rollers prepared in manners in which the agitation speed among the agitation conditions for the emulsion composition was within a range of 300 to 1,500 rμm but the agitation conditions are different from those of Example 1, and each of the four types of fixing-unit rollers had a porous material in which a ratio of an area occupied by composite cells, which are each made of partially-overlapping spherical cells, in a 200-μm square in the cross section obtained by cutting the porous material to an area of the square was 60% or greater and 70% or less (each of the porous materials contained such cells that, when the cells were sorted in 5-μm increments, the number of cells that were 5 μm or greater and 10 μm or less in size was largest, and the percentage of the number of cells that were 10 μm or greater and 20 μm or less to the number of the cells that were 5 μm or greater and 10 μm or less was 50 or greater.) As in the case of the roller of Example 1, neither foam breakage nor damage was observed in the four types of fixing-unit rollers even after testing time exceeded 300 hours.

The reason why the fixing-unit roller according to the embodiment has high endurance can be understood as following. Generally, elastomeric foam having higher permeability (a so-called open-cell type) has higher resistance to stress when receiving compression or shearing stress. When a porous material of a conventional closed-cell type (Comparative Example 2) or a porous material of a conventional open-cell type (Comparative Example 1; cells communicate with each other via very narrow paths (made by water which is the dispersant)) is compressed, foam breakage is likely to occur. This is because cells are compressed in these porous materials and thus a pressure (stress) is repeatedly applied to walls surrounding the cells. In contrast, the porous material forming the elastic layer of the fixing-unit roller according to the embodiment has composite cells which are each made of partially-overlapping spherical cells. In this porous material, concentration of stress is less likely to occur because the composite cells are small and vary widely in size, and, furthermore, walls surrounding the cells are complicated in shape. As a result, endurance is increased.

In the fixing-unit roller of the embodiment, the porous material containing cells that are 0.1 μm or greater and 50 μm or less in size in a cross section obtained by cutting the porous material, and a ratio of an area occupied by composite cells, which are made of partially-overlapping spherical cells, in a 200-μm square in the cross section to an area of the square is 60% or greater and 70% or less. As a result, the fixing-unit roller can provide a wide nip width even when the fixing-unit roller has a small diameter, and reduce warm-up time while being highly durable.

The fixing-unit roller of the embodiment is configures such that the porous material containing cells that are 0.1 μm or greater and 50 μm or less in size, and, when cells of the porous material that are 5 μm or greater and 50 μm or less in size are sorted in 5-μm increments, cells that are 5 μm or greater and 10 μm or less are largest in number. As a result, because a stress caused by pressure application can be distributed evenly, the fixing-unit roller can provide a wide nip width even when the fixing-unit roller has a small diameter, and reduce warm-up time while being highly durable.

In the fixing-unit roller of the embodiment, a ratio of the number of cells that are 10 μm or greater and 20 μm or less to the number of cells that are 5 μm or greater and 10 μm or less is 45% or greater. As a result, because a stress caused by pressure application can be distributed more evenly, higher endurance can be obtained.

The porous material of the fixing-unit roller of the embodiment is formed from water-foamed silicone rubber. As a result, the fixing-unit roller having high heat resistant endurance can be obtained.

The porous material of the fixing-unit roller of the embodiment further includes a releasing layer formed from any one of tetrafluoroethylene-perfluoroalkylvinyl ether copolymer and polytetrafluoroethylene as an outermost layer. The releasing layer prevents toner fixation onto the roller, thereby enhancing paper releasability in duplex printing or a like situation.

The fixing unit of the embodiment includes the fixing-unit roller as described above. As a result, the fixing unit has sufficiently-high fixing performance while being compact, and also achieves reduction in warm-up time while being highly durable.

The image forming apparatus of the embodiment includes the fixing unit. As a result, the fixing unit has sufficiently-high fixing performance while being compact, and also achieves reduction in warm-up time while being highly durable.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing-unit roller comprising:

a core bar; and an elastic layer formed on an outer peripheral surface of the core bar, the elastic layer being formed from a porous material that contains a plurality of cells, wherein cells in a cross section obtained by cutting the porous material are 0.1 μm or greater and 50 μm or less in size, and a ratio of an area occupied by composite cells in a 200-μm square in the cross section to an area of the square is 60% or greater and 70% or less, the composite cells being made of partially-overlapping spherical cells.

2. The fixing-unit roller according to claim 1, wherein, when cells of the porous material that are 5 μm or greater and 50 μm or less in size are sorted in 5-μm increments, cells that are 5 μm or greater and 10 μm or less are largest in number.

3. The fixing-unit roller according to claim 2, wherein a ratio of number of cells that are 10 μm or greater and 20 μm or less to number of cells that are 5 μm or greater and 10 μm or less is 50% or greater.

4. The fixing-unit roller according to claim 1, wherein the porous material is formed from water-foamed silicone rubber.

5. The fixing-unit roller according to claim 1 further comprising a releasing layer formed from any one of tetrafluoroethylene-perfluoroalkylvinyl ether copolymer and polytetrafluoroethylene as an outermost layer.

6. A fixing unit comprising a fixing-unit roller, the fixing-unit roller comprising:

a core bar; and an elastic layer formed on an outer peripheral surface of the core bar, the elastic layer being formed from a porous material that contains a plurality of cells, wherein cells in a cross section obtained by cutting the porous material are 0.1 μm or greater and 50 μm or less in size, and a ratio of an area occupied by composite cells in a 200-μm square in the cross section to an area of the square is 60% or greater and 70% or less, the composite cells being made of partially-overlapping spherical cells.

7. An image forming apparatus comprising a fixing unit comprising a fixing-unit roller, the fixing-unit roller comprising:

a core bar; and an elastic layer formed on an outer peripheral surface of the core bar, the elastic layer being formed from a porous material that contains a plurality of cells, wherein cells in a cross section obtained by cutting the porous material are 0.1 μm or greater and 50 μm or less in size, and a ratio of an area occupied by composite cells in a 200-μm square in the cross section to an area of the square is 60% or greater and 70% or less, the composite cells being made of partially-overlapping spherical cells.

* * * * *